US005807668A

United States Patent [19]

Fodor et al.

[11] Patent Number: 5,807,668

[45] Date of Patent: Sep. 15, 1998

[54] HARDENING OF HYDROPHILIC COLLOIDS

[75] Inventors: Ludovic U. Fodor, Beaumont, Tex.; Timothy D. Weatherill, Hendersonviille, N.C.; Rolf T. Weberg, East Aurora, N.Y.

[73] Assignee: Sterling Diagnostic Imaging, Inc., Brevardd, N.C.

[21] Appl. No.: 819,538

[22] Filed: Mar. 17, 1997

[51] Int. Cl.[6] ..... G03C 1/30

[52] U.S. Cl. ..... 430/621; 430/623; 430/631; 430/642; 430/935; 427/338

[58] Field of Search ..... 430/623, 621, 430/642, 631, 935; 427/338, 301

[56] References Cited

U.S. PATENT DOCUMENTS

| | | | |
|---|---|---|---|
| 2,165,421 | 7/1939 | Sheppard et al. | 95/7 |
| 2,960,404 | 11/1960 | Milton et al. | 96/94 |
| 3,412,159 | 11/1968 | Fodor et al. | 260/617 |
| 3,640,721 | 2/1972 | Ishibara et al. | 96/114.4 |
| 5,378,842 | 1/1995 | Fodor et al. | 544/139 |
| 5,391,477 | 2/1995 | Weatherill | 430/642 |
| 5,459,029 | 10/1995 | Fodor et al. | 430/623 |
| 5,470,986 | 11/1995 | Fodor et al. | 548/312.7 |
| 5,527,665 | 6/1996 | Fodor et al. | 430/623 |
| 5,591,863 | 1/1997 | Fodor et al. | 548/312.7 |
| 5,601,971 | 2/1997 | Fodor et al. | 430/621 |

FOREIGN PATENT DOCUMENTS

| | | |
|---|---|---|
| 0283938 | 9/1988 | European Pat. Off. . |
| 0576911 | 1/1994 | European Pat. Off. . |

*Primary Examiner*—Thorl Chea
*Attorney, Agent, or Firm*—Joseph T. Guy, Jr.

[57] ABSTRACT

An improved method for increaseing the hardening in a photographic element is described. The hardener is an imidazolium compound of formula:

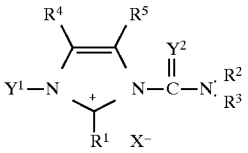

and the imidazolium is used in conjunction with a hardening accelerator defined by:

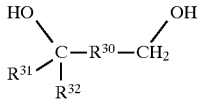

the substituents are listed in the specification.

17 Claims, No Drawings

HARDENING OF HYDROPHILIC COLLOIDS

FIELD OF INVENTION

This invention is related to improvements in the hardening of hydrophilic colloids. This invention is particularly related to improved hardening of hydrophilic colloids by the use of imidazolium hardeners in combination with specific hardening accelerators.

BACKGROUND OF THE INVENTION

Proteinaceous materials, also referred to as hydrophilic colloids, are used for a wide variety of applications. Useful properties include their ability to swell in aqueous solutions and yet still form a solid matrix which is permeable to aqueous solutions upon drying. These properties have been exploited for many decades in the field of photographic science. Proteinaceous materials are still widely used as a binder for silver halide grains in the photosensitive layer of photographic films. A particular type of proteinaceous material is gelatin as commonly employed in photographic coatings.

Gelatin coatings are used in various fields of technology. Examples include protective coatings on objects; binder coatings for reagents in materials for analytical or diagnostic purposes; and light-sensitive materials, preferably silver halides, in photographic recording materials. For practical use, these coatings are hardened by the addition of a hardener. Known hardeners act by cross-linking the free amino, imino, or hydroxyl groups of the gelatin.

Imidazolium based hardeners are described in U.S. Pat. Nos. 5,470,986; 5,527,665; 5,459,029; 5,378,842; 5,591,863 and 5,601,971.

Imidazolium based hardeners are theorized to react with a carboxyl group on the gelatin to form an "activated carboxyl". The activated carboxyl is reactive towards an amine of the gelatin to form an amide bond liberating an imidazolium byproduct. Additives which react with the imidazolium are known to compete with the gelatin. This observation has been used advantageously to form derivatized gelatin as detailed in U.S. Pat. No. 5,391,477 and Europ. Pat. Appl. 0 576 911 A2, published Jan. 5, 1994. Based on the available teachings in the art, alcohols are not thought to react with imidazoliums and simple alcohols such as methanol are routinely used as optional coating aids in photographic coatings without regard for the presence or absence of imidazolium hardeners.

Diols, and higher alcohols, with at least three carbon atoms separating the hydroxy groups have been taught to act as plasticizers by allowing the binder to be more elastic in U.S. Pat. No. 2,960,404. Increasing the elasticity of the binder is contrary to increasing hardness of the binder. Therefore, a skilled artisan would not anticipate that certain polyols, with specific hardeners, act synergistically to increase the hardening of the binder layer.

Detailed in the present invention is the unexpected result that compounds comprising at least two alcohol groups, wherein at least one alcohol group is a primary alcohol, increases the effectiveness of imidazolium hardeners.

SUMMARY OF THE INVENTION

It is an object of the present invention to provide an improved method for hardening hydrophilic colloids.

It is another object of the present invention to increase the activity of imidazolium based hardeners by incorporating an additive.

A special feature of the present invention is the ability to obtain higher binder strength (as measured by melt time) without increasing the amount of hardener required.

These and other features are provided in a photographic element comprising a photosensitive layer and a hydrophilic colloid layer wherein at least one of either the photosensitive layer or the hydrophilic colloid layer is hardened with at least one imidazolium compound of formula:

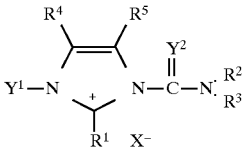

wherein:

$Y^1$ is an alkyl of 1 to 24 carbons; aryl of 6 to 24 carbons; aralkyl of 7 to 25 carbons; a 5- or 6-membered ring containing atoms chosen from a group consisting of C, N, O, and S; $—L^1CR^8CH_2$ or a polymer thereof; $—C(Y^4)E$; or

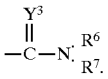

E is an alkyl of 1 to 24 carbons; aryl of 6 to 24 carbons; aralkyl of 7 to 25 carbons; $—OR^9$; —CN; or a 5- or 6-membered ring containing atoms chosen from a group consisting of C, N, O, and S. $L^1$ is a linking group. $R^1$ is hydrogen; alkyl of 1 to 24 carbons; aryl of 6 to 24 carbons; aralkyl of 7 to 25 carbons; $—OR^{10}$; halogen; nitro; carboxyl; mercapto; alkylamino of 1 to 24 carbons; or a 5- or 6-membered ring containing atoms chosen from a group consisting of C, N, O, and S. $R^2$ and $R^3$ independently represent hydrogen; alkyl of 1 to 24 carbons; aryl of 6 to 24 carbons; or aralkyl of 7 to 25 carbons; or $R^2$ and $R^3$ independently represent, or are taken together to represent, a 5- or 6-membered ring containing atoms chosen from a group consisting of C, N, O, and S. $R^4$ and $R^5$ independently represent hydrogen; alkyl of 1 to 24 carbons; aryl of 6 to 24 carbons; aralkyl of 7 to 25 carbons; nitro; carboxyl; mercapto; $—OR^{11}$; halogen; alkylamino of 1 to 24 carbons; or a 5- or 6-membered ring containing atoms chosen from a group consisting of C, N, O, and S; or $R^4$ and $R^5$ taken together represent a 5- or 6-membered ring containing atoms chosen from a group consisting of C, N, O, and S. $X^-$ is a counterion. $Y^2$, $Y^3$ and $Y^4$ independently represent O or S. $R^6$ and $R^7$ independently represent hydrogen; alkyl of 1 to 24 carbons; aryl of 6 to 24 carbons; aralkyl of 7 to 25 carbons; or a 5- or 6-membered ring containing atoms chosen from a group consisting of C, N, O, and S; or $R^6$ and $R^7$ taken together represent the atoms chosen from C, N, O and S necessary to form a 5- or 6-member ring. $R^8$ represents a hydrogen; alkyl of 1 to 24 carbons; $—C(O)R^{12}$; —CN; or aryl of 6 to 24 carbons. $R^9$ represents hydrogen; alkyl of 1 to 24 carbons; or aryl of 6 to 24 carbons. $R^{10}$ and $R^{11}$ independently represent hydrogen or alkyl of 1 to 5 carbons. $R^{12}$ represents hydrogen; alkyl of 1 to 24 carbons; alkoxy of 1 to 24 carbons; amine; or alkylamine of 1 to 24 carbons. The hydrophilic colloid layer further comprises at least one hardening accelerator defined by

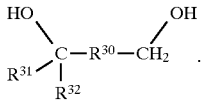

$R^{30}$ is a chemical bond or alkyl of 1 to 12 carbons; aryl of 6 to 10 carbons, arylalkyl of 7 to 25 carbons; or —$(R^{33}$—O—$R^{34})_n$—. $R^{31}$ and $R^{32}$ independently represent hydrogen or alkyl of 1 to 12 carbons. $R^{33}$ and $R^{34}$ independently represent alkyl of 1 to 12 carbons.

More preferably the features are provided in a photographic element comprising a photosensitive layer and at least one hydrophilic colloid layer hardened with at least one imidazolium compound of formula:

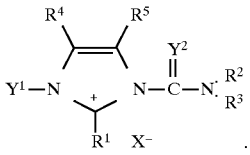

$Y^1$ is

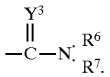

$R^1$ is hydrogen; alkyl of 1 to 24 carbons. $R^2$ and $R^3$ independently represent hydrogen; alkyl of 1 to 24 carbons; aryl of 6 to 24 carbons; aralkyl of 7 to 25 carbons; or a 5- or 6-membered ring containing atoms chosen from a group consisting of C, N, O, and S; or $R^2$ and $R^3$ taken together represent a 5- or 6-membered ring containing atoms chosen from a group consisting of C, N, O, and S. $R^4$ and $R^5$ independently represent hydrogen; alkyl of 1 to 24 carbons; halogen; or $R^4$ and $R^5$ taken together represent a 5- or 6-membered ring containing atoms chosen from a group consisting of C, N, O, and S. $X^-$ is a counterion. $Y^2$, $Y^3$ represent O. $R^6$ and $R^7$ independently represent hydrogen; alkyl of 1 to 24 carbons; aryl of 6 to 24 carbons; aralkyl of 7 to 25 carbons; or a 5- or 6-membered ring containing atoms chosen from a group consisting of C, N, O, and S; or $R^6$ and $R^7$ taken together represent a 5- or 6-membered ring containing atoms chosen from a group consisting of C, N, O, and S. The hydrophilic colloid layer further comprises a hardening accelerator defined by:

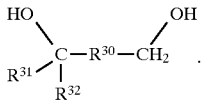

$R^{30}$ is a chemical bond or alkyl of 1 to 12 carbons; aryl of 6 to 10 carbons, arylalkyl of 7 to 25 carbons; or —$(R^{33}$—O—$R^{34})_n$—. $R^{31}$ and $R^{32}$ independently represent hydrogen or alkyl of 1 to 12 carbons. $R^{33}$ and $R^{34}$ independently represent alkyl of 1 to 12 carbons.

The manner in which the invention is excercised is provided in a process for forming a photographic element, comprising:

a) forming at least one liquid photographic emulsion in at least one storage vessel wherein said liquid photographic emulsion comprises silver halide, hydrophilic colloid and a hardening accelerator defined by:

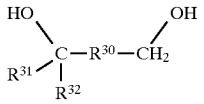

wherein the substituents are further described herein;

b) transporting said liquid photographic emulsion to an injection region;

c) injecting into said liquid photographic emulsion in said injection region at least one imidazolium compound defined by

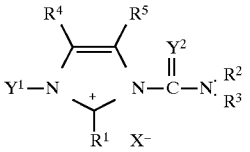

wherein the substituents are defined herein;

d) transporting said liquid photographic emulsion to a coater;

e) coating said liquid photographic emulsion on a substrate; and f) removing said solvent from said liquid photographic emulsion to form a dry coated emulsion layer.

DETAILED DESCRIPTION OF THE INVENTION

Photographic elements of the present invention comprise one or more binder layers and at least one of the binder layers is crosslinked with at least one imidazolium hardener defined by Formula I, and a hardening accelerator defined by Formula II.

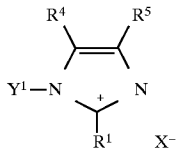

Formula I

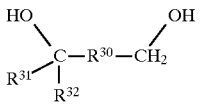

Formula II

Referring specifically to Formula I, $Y^1$ is an alkyl, or substituted alkyl, of 1 to 24 carbons; aryl, or substituted aryl, of 6 to 24 carbons; aralkyl, or substituted aralkyl, of 7 to 25 carbons; a 5- or 6-membered ring containing atoms chosen from a group consisting of C, N, O, and S; —$L^1CR^8CH_2$ or a polymer thereof;

—$C(Y^4)E$; or

—$C(Y^4)E$; or

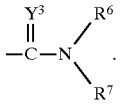

More perferably $Y^1$ is a 5- or 6-membered ring containing atoms chosen from a group consisting of C, N, O, and S or

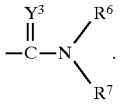

More preferably $Y^1$ is

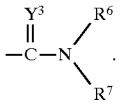

E is an alkyl, or substituted alkyl, of 1 to 24 carbons; aryl, or substituted aryl, of 6 to 24 carbons; aralkyl, or substituted aralkyl, of 7 to 25 carbons; —$OR^9$; —CN; or a 5- or 6-membered ring containing atoms chosen from a group consisting of C, N, O, and S. More preferably E is an alkyl, or substituted alkyl, of 1 to 6 carbons; aryl, or substituted aryl, of 6 to 10 carbons; —$OR^9$; or a 5- or 6-membered ring containing atoms chosen from a group consisting of C, N, O, and S.

$L^1$ is a linking group preferably chosen from a covalent chemical linkage; alkyl, or substituted alkyl, of 1 to 20 carbons; aryl, or substituted aryl, of 6–24 carbons; aralkyl, or substituted aralkyl, of 7 to 25 carbons; and carboxyl. Most preferably $L^1$ represents a chemical linkage; or an alkyl, or substituted alkyl, of 1 to 3 carbons.

$R^1$ is hydrogen; alkyl, or substituted alkyl, of 1 to 24 carbons; aryl, or substituted aryl, of 6 to 24 carbons; aralkyl, or substituted aralkyl, of 7 to 25 carbons; halogen; —$OR^{10}$; halogen; nitro; carboxyl; mercapto; alkylamino, or substituted alkylamino, of 1 to 24 carbons; or a 5- or 6-membered ring containing atoms chosen from a group consisting of C, N, O, and S. Preferably $R^1$ represents hydrogen; alkyl, or substituted alkyl, of 1 to 3 carbons; aryl, or substituted aryl, of 6 to 10 carbons; or aralkyl, or substituted aralkyl, of 7 to 11 carbons. Most preferably $R^1$ represents hydrogen; or alkyl, or substituted alkyl, of 1 to 3 carbons.

$R^2$ and $R^3$ independently represent hydrogen; alkyl, or substituted alkyl, of 1 to 24 carbons; aryl, or substituted aryl, of 6 to 24 carbons; or aralkyl, or substituted aralkyl, of 7 to 25 carbons. $R^2$ and $R^3$ independently can represent, or be taken together to represent, a 5- or 6-membered ring containing atoms chosen from a group consisting of C, N, O, and S. Preferably $R^2$ and $R^3$ independently represent alkyl, or substituted alkyl, of 1 to 6 carbons; aryl, or substituted aryl, of 6 to 10 carbons; or aralkyl, or substituted aralkyl, of 7 to 11 carbons; or taken together $R^2$ and $R^3$ represent a 5- or 6-membered ring containing atoms chosen from a group consisting of C, N, and O. Most preferably $R^2$ and $R^3$ independently represent alkyl, or substituted alkyl, of 1 to 3 carbons or $R^2$ and $R^3$ are taken together to represent a 5- or 6-membered ring containing atoms chosen from a group consisting of C, N, and O. If $R^2$ and $R^3$ are taken together to represent a 5- or 6-membered ring they can form a 5- or 6-membered saturated ring having 0 or 1 additional nitrogen atoms and 0 or 1 oxygen atoms, and the additional nitrogen atom is unsubstituted or substituted with a methyl, ethyl, or propyl group. In a particularly preferred embodiment $R^2$ and $R^3$ are taken together to represent morpholino.

$R^4$ and $R^5$ independently represent hydrogen; alkyl, or substituted alkyl, of 1 to 24 carbons; aryl, or substituted aryl, of 6 to 24 carbons; aralkyl, or substituted aralkyl, of 7 to 25 carbons; nitro; carboxyl; mercapto; —$OR^{11}$; halogen; or alkylamino, or substituted alkylamino, of 1 to 24 carbons. $R^4$ and $R^5$ independently can represent a 5- or 6-membered ring containing atoms chosen from a group consisting of C, N, O, and S or $R^4$ and $R^5$ can be taken together to represent a 5- or 6-membered ring containing atoms chosen from a group consisting of C, N, O, and S. Preferably $R^4$ and $R^5$ independently represent hydrogen; or alkyl, or unsubstituted alkyl, of 1 to 4 carbon atoms.

$R^6$ and $R^7$ independently represent hydrogen; alkyl, or substituted alkyl, of 1 to 24 carbons; aryl, or substituted aryl, of 6 to 24 carbons; or aralkyl, or substituted aralkyl, of 7 to 25 carbons. $R^6$ and $R^7$ independently can represent, or be taken together to represent, a 5- or 6-membered ring containing atoms chosen from a group consisting of C, N, O, and S. Preferably, $R^6$ and $R^7$ independently represent alkyl, or substituted alkyl, of 1 to 6 carbons; aryl, or substituted aryl, of 6 to 10 carbons; aralkyl, or substituted aralkyl, of 7 to 11 carbons; or taken together $R^6$ and $R^7$ can represent a 5- or 6-membered ring containing atoms chosen from a group consisting of C, N, and O. Most preferably, $R^6$ and $R^7$ represent alkyl, or substituted alkyl, of 1 to 3 carbons; or $R^6$ and $R^7$ are taken together to represent a 5- or 6-membered ring containing atoms chosen from a group consisting of C, N, and O. If $R^6$ and $R^7$ are taken together to represent a 5- or 6-membered ring they can form a 5- or 6-membered saturated ring having 0 or 1 additional nitrogen atoms and 0 or 1 oxygen atoms, and the additional nitrogen atom is unsubstituted or substituted with a methyl, ethyl, or propyl group. In a particularly preferred embodiment $R^6$ and $R^7$ are taken together to represent morpholino.

$R^8$ represents a hydrogen; an alkyl, or substituted alkyl, of 1 to 24 carbons; —$C(O)R^{12}$; —CN; or aryl, or substituted aryl, of 6 to 24 carbons.

$R^9$ represents hydrogen; alkyl, or substituted alkyl, of 1 to 24 carbons; or aryl, or substituted aryl, of 6 to 24 carbons.

$R^{10}$ and $R^{11}$ independently represent hydrogen; or an alkyl, or substituted alkyl, of 1 to 5 carbons.

$R^{12}$ represents hydrogen; alkyl, or substituted alkyl, of 1 to 24 carbons; alkoxy, or substituted alkoxy, of 1 to 24 carbons; amine; or alkyl amine, or substituted alkyl amine, of 1 to 24 carbons.

$Y^2$, $Y^3$ and $Y^4$ independently represent O or S.

$X^-$ is a counterion. $X^-$ can be a halide (e.g., chloride), a complex inorganic ion (e.g., perchlorate), a common organic ion (e.g., tetrafluoroborate), or an anion of a strong acid (e.g., toluene sulfonate). Preferably $X^-$ is chosen from a group consisting of halide, $CF_3SO_3$—, $ClO_4$—, $BF_4$— and p—$CH_3C_6H_4SO_3$—.

For the purposes of the present invention, the compound represented by:

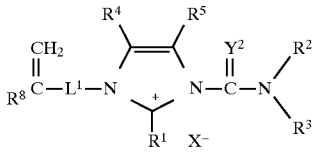

can be classified as a vinyl imidazolium. The vinyl imidazolium has a vinyl group that can be polymerized as known in the art to form a polymer. Preferably the vinyl group of the vinyl imidazolium can be polymerized with other substituted vinyl compounds to form a copolymer. Preferably the vinyl imidazolium is a copolymer defined by:

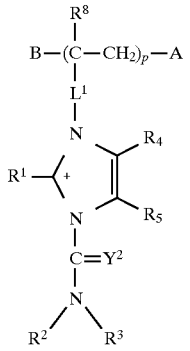

where $R^1$, $R^2$, $R^3$, $R^4$, $R^5$, $R^8$, $L^1$ and $Y^2$ correspond to the definitions above for similiarly referenced groups. The subscript "p" represents the mole fraction of vinyl imidazolium monomer in the polymer and is preferably no more than 95% and more preferably no more than 50%. A and B independently represent copolymerized monomers. Preferably the monomers A and B are independently chosen from a group consisting of acrylic acid ester, methacrylic acid ester, acrylamide, styrene, styrene sulfonate, maleic anhydride, butadiene and vinyl chloride.

Throughout this disclosure $CH_2{=}CR^8$— refers to an unpolymerized monomer. A polymer or copolymer formed by the polymerization or copolymerization of the vinyl group is also considered to be within the teachings of the present invention. The process of polymerization, or copolymerization, is well known in the art and includes specifically radical initiated polymerization.

Well known in the art is the advantage of using a surfactant to assist in coating a solution. Typically the surfactant is a separate entity which is useful during coating and can be detrimental after coating is complete. By incorporating the surfactant into the chemical structure of the hardener the detrimental properties can be circumvented. A preferred embodiment of the present invention is realized when at least one of $R^1$, $R^2$, $R^3$, $R^4$, $R^5$, $R^6$, $R^7$, or $R^{12}$ comprises a surfactant moiety incorporated into the chemical structure of the hardener. This allows a single compound to accomplish multiple tasks, namely, to act as a coating aid during the coating process after which the compound acts to crosslink the matrix as detailed above. Suitable surfactant moieties which are known in the art include alkyl chains over 6 carbons, preferably 6 to 24 carbons; polyalkyleneoxide chains such as —$(R^{27}O)_m$—, wherein $R^{27}$ is ethylene, propylene or combinations thereof and m is an integer of 1 to 30; or combinations of alkylenes and polyalkyleneoxides.

While not limited thereto, particularly preferred hardeners represented by Formula I are:

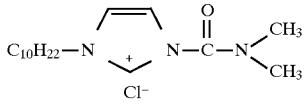

I-1

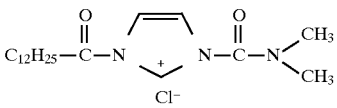

I-2

-continued

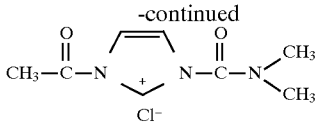

I-3

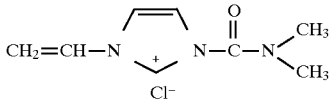

I-4

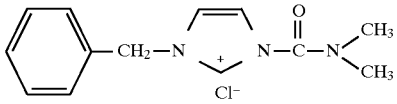

I-5

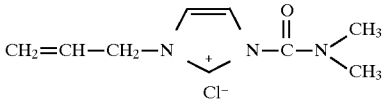

I-6

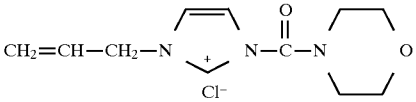

I-7

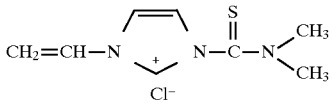

I-8

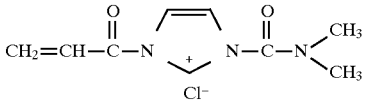

I-9

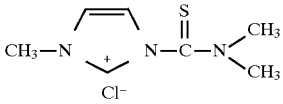

I-10

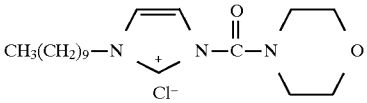

I-11

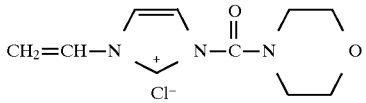

I-12

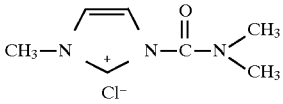

I-13

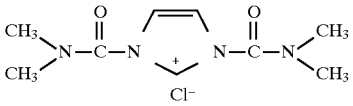

I-14

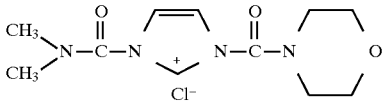

I-15

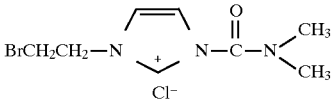

I-16

-continued

I-17

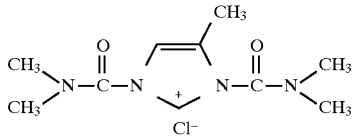

I-18

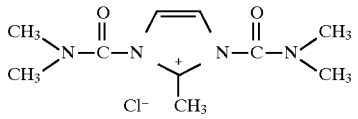

I-19

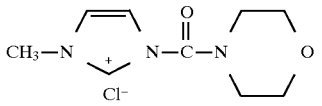

I-20

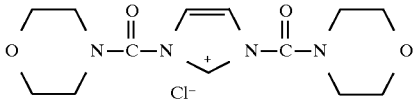

I-21

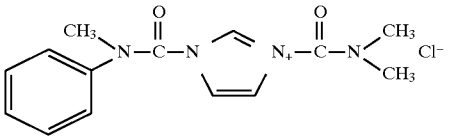

I-22

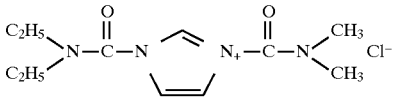

I-23

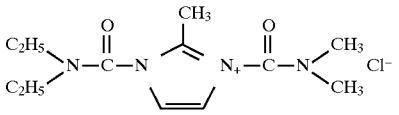

I-24

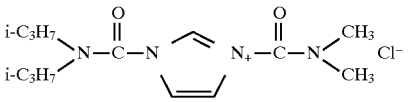

I-25

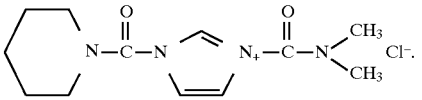

The structure of the imidazolium ring is known to exist with a delocalized charge. Comparable resonance structures can be drawn including:

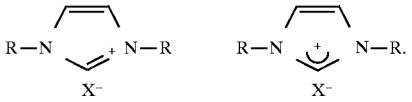

Referring specifically to the hardening accelerator of Formula II.

$R^{30}$ is a chemical bond or alkyl of 1 to 12 carbons; aryl of 6 to 10 carbons, arylalkyl of 7 to 25 carbons; or —$(R^{33}$—O—$R^{34})_n$—. Preferably $R^{30}$ is alkyl of 2 to 10 carbons; aryl of 6 carbons; arylalkyl of 7 to 18 carbons; or —$(R^{33}$—O—$R^{34})_n$—. More preferably, $R^{30}$ is alkyl of 3 to 7 carbons substituted with alkoxy of 1 to 6 carbons; aryl of 6 carbons; arylalkyl of 7 to 10 carbons; or —$(R^{33}$—O—$R^{34})_n$—.

$R^{31}$ and $R^{32}$ independently represent hydrogen or alkyl of 1 to 12 carbons. Preferably, $R^{31}$ and $R^{32}$ independently represent hydrogen or alkyl of 1 to 10 carbons. Most preferably, $R^{31}$ and $R^{32}$ independently represent hydrogen or alkyl of 1 to 7 carbons. When $R^{30}$ represents a chemical bond at least one of $R^{31}$ or $R^{32}$ is preferably an alkyl of at least 2 carbons.

$R^{33}$ and $R^{34}$ independently represent alkyl of 1 to 12 carbons.

Particularly preferred compounds of Formula II are represented by:

IA-1

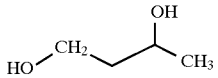

IA-2

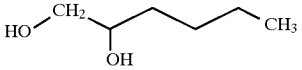

IA-3

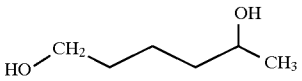

IA-4

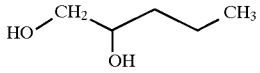

IA-5

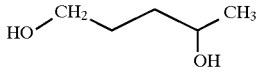

IA-6

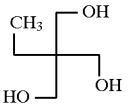

IA-7

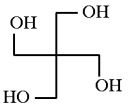

IA-8

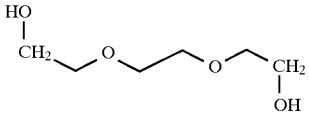

IA-9

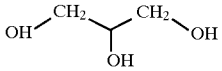

or

IA-10

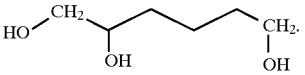

The recitation "atoms chosen from C, N, O, and S necessary to form a 5- or 6-membered ring" or the equivalent thereof "a 5- or 6-membered ring containing atoms chosen from a group consisting of C, N, O, and S" refers to substituted or unsubstituted rings including but not limited to: the thiazole series; e.g. thiazole, 4-methylthiazole, 4-phenylthiazole, 5-methylthiazole, 5-phenylthiazole, 4,5-dimethylthiazole, 4,5-diphenylthiazole, or 4—(2-thienyl)-thiazole;

the benzothiazole series; e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole, or 6-hydroxybenzothiazole;

the naphthothiazole series; e.g., naphtho[1,2]-thiazole, naphtho[2,1]thiazole, 5-methoxynaphtho-[2,1]-thiazole, 5-ethoxynaphtho[2,1]thiazole, 8-methoxynaphtho[1,2] thiazole, or 7-methoxynaphtho[1,2]thiazole;

the thianaphtheno-7',6',4,5-thiazole series; e.g. 4'-methoxythianaphtheno-7',6',4,5-thiazole;

the oxazole series; e.g., 4-methyloxazole, 5-methyloxazole, 4-phenyloxazole, 4,5-diphenyloxazole, 4-ethyloxazole, 4,5-dimethyloxazole, or 5-phenyloxazole;

the benzoxazole series; e.g., benzoxazole, 5-chlorobenzoxazole, 5-methylbenzoxazole, 5-phenylbenzoazole, 6-methylbenzoxazole, 5,6-dimethylbenzoxazole, 4,5-dimethylbenzoxazole, 5-methoxybenzoxazole, 5-ethoxybenzoxazole, 5-chlorobenzoxazole, 6-methoxybenzoxazole, 5-hydroxybenzoxazole, or 6-hydroxybenzoxazole;

the naphthoxazole series, e.g., naphtho[1,2]oxazole, or naphtho[2,1]oxazole;

the thiazoline series; e.g., thiazoline, or 4-methylthiazoline;

the 2-quinoline series; e.g., quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, or 8-hydroxyquinoline;

the 4-quinoline series; e.g., quinoline, 6-methoxyquinoline, 7-methoxyquinoline, 7-methylquinoline, or 8-methylquinoline;

the 1-isoquinoline series; e.g., isoquinoline, or 3,4-dihydroisoquinoline;

the 3-isoquinoline series; e.g., isoquinoline;

the benzimidazole series; e.g., 1,3-diethylbenzimidazole, or 1-ethyl-3-phenylbenzimidazole;

the 3,3-dialkylindolenine series; e.g., 3,3-dimethylindoline, 3,3,5-trimethylindolenine, or 3,3,7-trimethylindolenine;

the 2-pyridine series; e.g., pyridine, or 5-methylpyridine;

the 4-pyridine series;

the 3,3-dialkylbenz[e]indole series; e.g., 3,3-dimethylbenz[e]indole;

the tetrazole series: e.g., 1-phenyltetrazole, or 1-methyltetrazole;

the triazole series: e.g., 1-phenyl-triazole, or 1-methyltriazole;

the pyrimidine series: e.g., pyrimidine;

the thiadiazole series: e.g., 1,3,4-thiadiazole.

The terms "alkyl", "aryl", "aralkyl", "5- or 6-membered ring", "ether", "ethylene", "phenyl", "alkoxy", and "benzyl" refer to both unsubstituted and substituted groups unless specified to the contrary. Preferred substituents include halogen, nitro, carboxyl, hydroxyl, alkoxy, amine, thiol, amide, vinyl, sulfate, cyano, thioether, carboxylic acid, sulfonic acid, sulfato, and combinations thereof.

A process of hardening gelatin coatings is accomplished preferably by mixing an aqueous gelatin coating solution with an aqueous solution of the hardener just before coating.

It is particularly preferable to accomplish this mixing immediately before coating, for example, by injecting the hardener solution into a stream of the coating solution at the coating device.

The hardeners of the present invention are preferably added by injection into the coating solution as the coating solution is transported from the holding tanks to the coater. The injection time is dependent on the coater configuration but the time between injection and coating must be sufficiently long to allow thorough mixing. It is also important that the time is not so long that crosslinking and decomposition begin to occur. An addition time of no more than approximately 5 minutes prior to coating is preferred and no more than 2 minutes is most preferred. While not restricted thereto it is most preferred that the imidazolium compounds of Formula I are injected into the emulsion layer of a photographic element and the hardening accelerators of Formula II are included in the emulsion layer prior to coating. Injection is accomplished by passing the coating solution past a "T" and adding the appropriate hardener solution. After the "T" the two solutions are allowed to mix sufficiently. It is most common for the coating solution to flow substantially straight through the "T" and for the hardener to be injected into the coating solution at an angle.

The photographic element of the present invention can be coated onto a substrate with any method common in the art including but not limited to curtain coating, extrusion coating, slide-bead coating and the like. Slide-bead coating is a preferred method.

Slide-bead coating is well known in the art to provide a means for supplying a flowing liquid layer or plurality of liquid layers down a slide surface to an efflux end, or lip, at which a liquid bridge, or bead, is formed in a gap between the lip and a moving substrate. The moving substrate carries away liquid from the liquid inventory in the bead in the same layered structure established on the slide. Exemplary examples include, for example, Russell, et.al., U.S. Pat. Nos. 2,761,791 and 2,761,419.

The amount of hardener solution added depends on the degree of crosslinking desired. For use in a photographic emulsion the imidazolium hardener solution is typically added in an amount sufficient to equal approximately 0.01 to 1.0 mmoles of the hardener represented by Formula I per gram of hydrophilic colloid and approximately 0.01 to 1.0 grams of the hardening accelerator of the Formula II per gram of hydrophilic colloid. More preferred is approximately 0.02 to 0.30 mmoles of the imidazolium hardener represented by Formula I per gram of hydrophilic colloid and approximately 0.02 to 0.30 grams of the hardening accelerator represented by Formula II per gram of hydrophilic colloid. Most preferred is 0.05 to 0.15 grams of hardening accelerator per gram of hydrophilic colloid. The amount added can be different for different hydrophilic colloids.

The hardeners of the present invention are most suitable for crosslinking a hydrophilic colloid layer. It is most preferred to use the hardeners of the present invention for a coated layer of hydrophilic colloid. The commercial application includes, but is not limited to, the use of a hardened hydrophilic colloid layer in a photographic element as either a photosensitive layer, an underlayer, an overcoat layer or a dyed layer.

The process of hardening gelatin coatings according to the invention is used preferably for hardening gelatin-containing coatings that are components of photographic recording materials. These can be light-sensitive silver halide emulsion coatings that contain, for example, unsensitized emulsions, orthochromatic, panchromatic, or infrared-sensitive emulsions, emulsions containing color couplers, x-ray emulsions, or ultrahigh contrast emulsions for reprography. The hardened gelatin coatings can be protective coatings, filter coatings, antihalation coatings, anticurl coatings, or photographic auxiliary coatings in general. Photographic recording materials, particularly those for color photography, usually contain several such coatings.

A photosensitive layer typically comprises silver halide dispersed in a hydrophilic colloid binder. The silver halide is optionally chemically and optionally spectrally sensitized as known in the art and the layer can contain other adjuvants such as dyes, stabilizers, development agents, color coupling agents, toners, surfactants, and the like.

An underlayer typically comprises a hydrophilic colloid layer with an optional dye dispersed therein. The overcoat is typically coated as the outermost layer to protect the photosensitive layer from abrasion and the like. The overcoat layer can comprise dyes, surfactants, or other adjuvants as known in the art.

The term "hydrophilic colloid" or its homologues "gelatin" and "proteinaceous material" are used herein to refer to protein substances which are derived from collagen. In the context of the present invention "hydrophilic colloid" also refers to substantially equivalent substances such as synthetic analogues of gelatin. Generally gelatin is classified as alkaline gelatin, acidic gelatin or enzymatic gelatin. Alkaline gelatin is obtained from the treatment of collagen with a base such as calcium hydroxide. Acidic gelatin is that which is obtained from treatment of collagen in acid such as hydrochloric acid. Enzymatic gelatin is generated with a hydrolase treatment of collagen. The teachings of the present invention are not restricted to gelatin type or to the molecular weight of the gelatin.

To harden several coatings superimposed upon one another on one side of a support in photographic recording materials, the hardener is added preferably only to one layer, for example, an undercoat or overcoat, which itself can be without gelatin. This can also be an auxiliary layer, for example, in the process according to Reif, U.S. Pat. No. 5,034,249. It is also possible to apply a solution containing hardener subsequently in a special process step onto the layers containing gelatin.

The imidazolium hardeners can be prepared simply and from easily available starting materials. They harden as rapidly as known instant hardeners, but are substantially more stable as solids and in aqueous solution. The solids, their solutions, and gelatin coatings hardened by them are free of annoying and harmful odors.

The invention can be used to harden all types of gelatin coatings. Examples include, protective coatings on objects, coatings containing reactive materials for analytical or diagnostic purposes, and light-sensitive coatings and auxiliary coatings on photographic recording materials.

The film support for the emulsion layers used in the novel process can be any suitable transparent plastic. For example, the cellulosic supports, e.g., cellulose acetate, cellulose triacetate, cellulose mixed esters, etc., can be used. Polymerized vinyl compounds, e.g., copolymerized vinyl acetate and vinyl chloride, polystyrene, and polymerized acrylates can also be used. Preferred film supports include those formed from the polyesterification product of a dicarboxylic acid and a dihydric alcohol made according to the teachings of Alles, U.S. Pat. No. 2,779,684 and the patents referred to in the specification thereof. Other suitable supports are polyethylene terephthalate/isophthalates of British Patent 766,290 and Canadian Patent 562,672 and those obtainable by condensing terephthalic acid and dimethyl terephthalate with propylene glycol, diethylene glycol, tetramethylene glycol or cyclohexane 1,4-dimethanol (hexahydro-p-xylene alcohol). Films of the type described in Bauer et al., U.S. Pat. No. 3,052,543 can also be used. The above polyester films are particularly suitable because of their dimensional stability.

Meltpoint was measured by observing the melting temperature in 0.1M NaOH for a hardened gelatin coating. Melt time was measured by observing the time, in minutes, required for the hardened layer to dissolve in a 1.5% NaOH solution at 50° C. Water absorption was determined by weighing a dry 10 cm×10 cm film sample, submerging the sample for 30 minutes in an aqueous solution buffered to a pH of approximately 10.0 by a borate buffer, allowing the excess water on the surface to drain off of the film, and weighing the swollen film. Water absorption (WA) is defined as the weight gain per surface unit or as a percentage according the the equation:

$$\% WA = \frac{\text{Wet weight(mg)} - \text{Dry weight(mg)}}{\text{Dry Weight(mg)}} \times 100$$

Wet gouge is a measure of the strength of the binder under processing conditions and is measured by dragging a stylus which increases force with distance over a film submerged in a mock developer solution comprising all ingredients except hydroquinone and phenidone. The wet gouge is then determined as the distance traversed by the stylus prior to destruction of the film surface. A larger distance indicates a stronger matrix.

SYNTHESIS OF HARDENERS OF FORMULA I

The imidazolium compounds of the invention can be produced by various synthetic procedures. Therefore, an optimum method can be selected for preparing a specific compound.

The synthesis is usually started with an imidazole compound and has two steps, whereby the imidazole is reacted first with an equivalent of a carbamoyl chloride and the resulting intermediate product is then reacted with another equivalent of the same or a different carbamoyl chloride. Thus, symmetrical or asymmetrical compounds can be obtained.

As an example, imidazole can be reacted in the presence of an acid scavenger, for example, triethylamine, with an equivalent of an N,N-dialkyl carbamoyl chloride. The preferred solvents for this are acetone and tetrahydrofuran. Triethyl ammonium chloride salt is precipitated and an intermediate product in the separated solution can be reacted with another equivalent of a dialkyl carbamoyl chloride to obtain a bis-carbamoyl compound. This crystallizes in a form sufficiently pure to use and can be easily filtered out.

The intermediate product can also be obtained by the reaction of sodium imidazole with an equivalent of a carbamoyl chloride in a polar solvent, for example, tetrahydrofuran, separating precipitated sodium chloride, and as above, processing further in the solution to the bis-carbamoyl compound.

Another possibility for preparing the monocarbamoyl imidazole intermediate product is reacting a carbomyl diimidazole with an equivalent of a secondary amine. Before further reaction, the intermediate product must be isolated and recrystallized to remove the imidazole formed in the first step.

1,3-bis-(dimethylcarbamoyl)-imidazolium chloride (I-14)

10.75 g (0.1 mole) dimethylcarbamoyl chloride are added dropwise with stirring to a solution of 6.8 g. (0.1 mole) imidazole and 11 g. triethylamine in 70 ml dry acetone. On warming, triethyl-ammonium chloride precipitates. After 5 hours standing at room temperature, the reaction mixture is filtered and 10.75 g. dimethyl-carbamoyl chloride is added again to the filtrate. After 2 days at room temperature, the crystalline product is filtered off, washed with acetone, and vacuum dried. Yield: 20.2 g 1,3-bis-(dimethylcarbamoyl)-imidazolium chloride (77% of theoretical), melting point 115° C. Analysis:

Calculated: C 43.8% H 6.08% N 22.7%.

Found: C 43.7% H 6.2% N 22.8%.

1,3-bis-(morpholinocarbonyl-imidazolium chloride (I-20)

7.5 g. (0.05 mole) morpholino-4-carbonyl chloride are added to a solution of 3.4 g. (0.05 mole) imidazole and 5.5 g. triethylamine in 60 ml dry tetrahydrofuran. The mixture is stirred 30 minutes at 50° C. The precipitated triethylammonium chloride is filtered off. An additional 7.5 g morpholino-4-carbonyl chloride are added to the filtrate. After standing 2 days at room temperature, crystals of 1,3-bis-(morpholinocarbonyl)-imidazolium chloride separate, are filtered off, washed with ether and vacuum dried. Yield: 9.6 g (58% of theoretical), melting point 116° C. Analysis:

Calculated: C 48.1% H 6.9% N 20.4%.

Found: C 48.0% H 7.0% N 20.6%.

Standard organic reaction synthetic procedures can be employed as known in the art. While other synthetic procedures can be employed, the hardeners of Formula I were prepared in a consistent manner according to the following procedure. The appropriate N-substituted imidazol (0.2 mol) and the appropriate carbonyl chloride, or thiocarbomyl chloride (0.2 mol) were dissolved in 100 ml. of acetone and refuxed for approximately 2 hrs. The reaction mixture was cooled to precipate the product which was then recovered by filtration. The filtrate was rinsed with acetone and dried in a dessicator at ambient conditions.

1-decyl-3-dimethylcarbamoylimidazolium bromide (I-1)

To 13.6 gm (0.2 mole) of imidazole (Aldrich Chemical Co., Milwaukee, Wis., 99%) and 20.2 gm of triethylamine (Aldrich, 99%) in 100 ml dry acetone (Fisher Scientific Co., Pittsburgh, Pa.) in a magnetically stirred 250 ml round bottom flask under dry nitrogen was added 21.5 gm (0.2 mole) dimethylcarbamyl chloride (Aldrich, 99%) dropwise over a 20 min. period from a side-arm pressure equalizing addition funnel. A white precipitate formed during the addition under conditions of mild exothermicity. The addition funnel was replaced with a reflux condenser and the reaction refluxed for a further one hour. After cooling to room temperature, the precipitate was isolated by Buchner filtration onto Wattman #1 paper, rinsed on the filter with acetone, and discarded. The combined filtrate and rinse acetone solution was divided into two equal parts, each containing 0.1 mole of 1-dimethylcarbamoylimidazole. To one of these parts was added 22.1 gm (0.1 mole) of 1-bromodecane (Aldrich 98%) and the solution refluxed for seven hours under dry nitrogen. The acetone was evaporated at water aspirator vacuum in a rotoevaporator to the point where two layers formed. The upper layer contained largely unreacted bromodecane and the lower yielded 12 gm (0.043 mole for a 21.4% theorical yield) of the imidazolium salt as a waxy solid upon cooling to 5° C. The purity and identity of this product was confirmed by proton and carbon NMR in deuterium oxide solution.

ILLUSTRATIVE EXAMPLES

The following examples illustrate the invention but are not intended to limit the invention in any way.

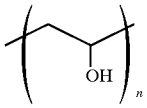

CA-1

-continued

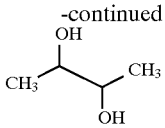

CA-2

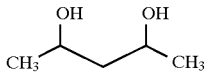

CA-3

EXAMPLE 1

An ultraviolet sensitive silver halide emulsion was prepared in accordance with the teachings of U.S. Pat. No. 5,108,887 and EPO 0 487 010 published May 27, 1992 using K&K 2688, K&K 7240 or Sanofi LHG gelatin as the hydrophilic colloid. Hardening accelerator IA-6 was added in the amount listed in Table 1. Poligen PE or Dow 620 latex was optionally added with no observed variation in the results attributable to the invention. Hardener I-23 was added in an amount approxiatly equal to 0.070 mmoles of hardener per gram of gelatin. The emulsion was coated on polyethylene terephthalate support to a silver coating weight of approximately 2.5 grams of silver per square meter and a gelatin/silver ratio of approximately 0.48. A standard gelatin abrasion layer was coated supra to the emulsion and 1.5 mmoles of 2,4-dichloro-6-hydroxy-1,3,5-s-triazine, sodium salt was added to the abrasion layer. Minimal change in fresh sensitometric properties were observed. The melt time of the abrasion and emulsion are reported in Table 1.

TABLE 1

| Amount | MTA | MTE | |
|---|---|---|---|
| 0 | 15 | 18 | Control |
| 3.3 | 30 | 33 | Inventive |
| 6.7 | 39 | 42 | Inventive |
| 10 | 36 | 36 | Inventive |
| 0 | 12 | 18 | Control |
| 3.3 | 30 | 33 | Inventive |
| 6.7 | 39 | 42 | Inventive |
| 10 | 39 | 42 | Inventive |

Amount is the grams of hardening accelerator added per mole of silver. MTA is the melt time (minutes) for the abrasion and MTE is the melt time (minutes) for the emulsion. Increases in melt time for the emulsion and abrasion are observed for the inventive samples relative to the controls.

EXAMPLE 2

An emulsion was prepared as in Example 1 except the hardener accelerator and amounts were altered as indicated in Table 2.

TABLE 2

| ACC | Amount | MTA | MTE | |
|---|---|---|---|---|
| — | — | 23 | 20 | Control |
| IA-6 | 8 | 33 | 33 | Inventive |
| IA-6 | 4 | 30 | 27 | Inventive |
| IA-6 | 3.3 | 27 | 27 | Inventive |
| IA-6 | 6.7 | 33 | 33 | Inventive |
| IA-9 | 3.3 | 30 | 30 | Inventive |
| IA-9 | 6.7 | 33 | 33 | Inventive |
| IA-10 | 3.3 | 24 | 24 | Inventive |
| IA-10 | 6.7 | 36 | 36 | Inventive |
| IA-7 | 3.3 | 27 | 27 | Inventive |

TABLE 2-continued

| ACC | Amount | MTA | MTE | |
|---|---|---|---|---|
| IA-7 | 6.7 | 39 | 39 | Inventive |
| CA-1 | 1 | 21 | 21 | Control |
| CA-1 | 10 | 21 | 21 | Control |

Amount is the amount of hardening accelerator, in grams, per mole of silver. ACC is the hardening accelerator added. MTA is the melt time (minutes) for the abrasion and MTE is the melt time (minutes) for the emulsion. An increase in melt time of the inventive examples is observed versus the control examples.

EXAMPLE 3

An emulsion was prepared as in Example 1 with 0.075 mmoles of hardener I-23 added per gram of gelatin. The hardening accelerator added and amount are provided in Table 3.

TABLE 3

| ACC | Amount | MT1 | MT7 | |
|---|---|---|---|---|
| — | — | 12 | 21 | Control |
| CA-1 | 13 | 12 | 18 | Control |
| IA-1 | 20 | 24 | 30 | Inventive |
| CA-2 | 20 | 18 | 21 | Control |
| IA-3 | 20 | 39 | 42 | Inventive |
| IA-4 | 20 | 24 | 30 | Inventive |
| IA-5 | 20 | 36 | 39 | Inventive |
| IA-6 | 20 | 12 | 21 | Inventive |
| IA-8 | 20 | 30 | 40 | Inventive |
| IA-2 | 13 | 27 | 33 | Inventive |
| CA-3 | 13 | 21 | 27 | Control |

ACC is the hardening accelerator added. Amount is the milligrams of hardening accelerator added per gram of hydrophilic colloid. MT1 is the melt time (minutes) after one week. MT7 is the melt time (minutes) after 7 weeks. An increase in melt time is observed for the inventive samples.

We claim:

1. A photographic element comprising a photosensitive layer and a first hydrophilic colloid layer hardened with 0.01 to 1.0 millimoles per gram of hydrophilic colloid of at least one imidazolium compound of formula:

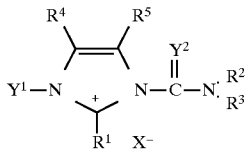

wherein:

$Y^1$ is an alkyl of 1 to 24 carbons; aryl of 6 to 24 carbons; aralkyl of 7 to 25 carbons; a 5- or 6-membered ring containing atoms chosen from a group consisting of C, N, O, and S; $—L^1CR^8CH_2$ or a polymer thereof; $—C(Y^4)E$; or

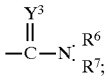

E is an alkyl of 1 to 24 carbons; aryl of 6 to 24 carbons; aralkyl of 7 to 25 carbons; $—OR^9$; —CN; or a 5- or 6-membered ring containing atoms chosen from a group consisting of C, N, O, and S;

$L^1$ is a linking group;

$R^1$ is hydrogen; alkyl of 1 to 24 carbons; aryl of 6 to 24 carbons; aralkyl of 7 to 25 carbons; $—OR^{10}$; halogen; nitro; carboxyl; mercapto; alkylamino of 1 to 24 carbons; or a 5- or 6-membered ring containing atoms chosen from a group consisting of C, N, O, and S;

$R^2$ and $R^3$ independently represent hydrogen; alkyl of 1 to 24 carbons; aryl of 6 to 24 carbons; or aralkyl of 7 to 25 carbons; or $R^2$ and $R^3$ independently represent, or are taken together to represent, a 5- or 6-membered ring containing atoms chosen from a group consisting of C, N, O, and S;

$R^4$ and $R^5$ independently represent hydrogen; alkyl of 1 to 24 carbons; aryl of 6 to 24 carbons; aralkyl of 7 to 25 carbons; nitro; carboxyl; mercapto; $—OR^{11}$; halogen; alkylamino of 1 to 24 carbons; or a 5- or 6-membered ring containing atoms chosen from a group consisting of C, N, O, and S; or $R^4$ and $R^5$ taken together represent a 5- or 6-membered ring containing atoms chosen from a group consisting of C, N, O, and S;

$X^-$ is a counterion;

$Y^2$, $Y^3$ and $Y^4$ independently represent O or S;

$R^6$ and $R^7$ independently represent hydrogen; alkyl of 1 to 24 carbons; aryl of 6 to 24 carbons; aralkyl of 7 to 25 carbons; or a 5- or 6-membered ring containing atoms chosen from a group consisting of C, N, O, and S; or $R^6$ and $R^7$ taken together represent the atoms chosen from C, N, O and S necessary to form a 5- or 6-member ring;

$R^8$ represents a hydrogen; alkyl of 1 to 24 carbons; $C(O)R^{12}$; —CN; or aryl of 6 to 24 carbons;

$R^9$ represents hydrogen; alkyl of 1 to 24 carbons; or aryl of 6 to 24 carbons;

$R^{10}$ and $R^{11}$ independently represent hydrogen or alkyl of 1 to 5 carbons; and $R^{12}$ represents hydrogen; alkyl of 1 to 24 carbons; alkoxy of 1 to 24 carbons; amine; or alkylamine of 1 to 24 carbons; and 0.02 to 0.30 grams of at least one hardening accelerator per gram of hydrophilic colloid wherein said hardening accelerator is defined by

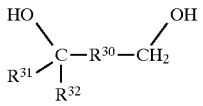

wherein:

$R^{30}$ is a chemical bond or alkyl of 1 to 12 carbons; aryl of 6 to 10 carbons, arylalkyl of 7 to 25 carbons; or $—(R^{33}—O—R^{34})_n—$;

$R^{31}$ and $R^{32}$ independently represent hydrogen or alkyl of 1 to 12 carbons; and $R^{33}$ and $R^{34}$ independently represent alkyl of 1 to 12 carbons.

2. The photographic element of claim 1 wherein:

$R^{30}$ is alkyl of 2 to 10 carbons; aryl of 6 carbons, arylalkyl of 7 to 18 carbons; or $—(R^{33}—O—R^{34})_n—$; and $R^{31}$ and $R^{32}$ independently represent hydrogen or alkyl of 1 to 10 carbons.

3. The photographic element of claim 2 wherein:

$R^{30}$ is alkyl of 3 to 7 carbons substituted with alkoxy of 1 to 6 carbons; aryl of 6 carbons, arylalkyl of 7 to 10 carbons; or $—(R^{33}—O—R^{34})_n—$;

$R^{31}$ and $R^{32}$ independently represent hydrogen or alkyl of 1 to 7 carbons.

4. The photographic element of claim 3 wherein said hardening accelerator is chosen from a group consisting of:

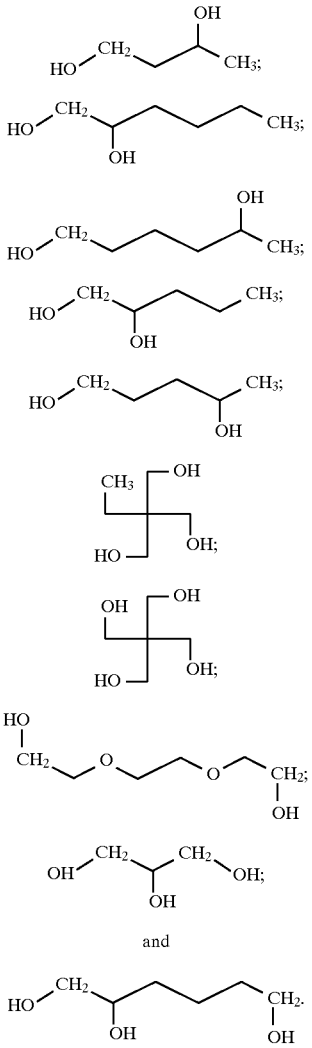

5. The photographic element of claim 1 wherein:

$Y^1$ is an alkyl of 1 to 24 carbons; aryl of 6 to 24 carbons; aralkyl of 7 to 25 carbons; a 5- or 6-membered ring containing atoms chosen from a group consisting of C, N, O, and S; or

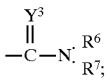

$L^1$ is chosen from a covalent chemical bond; alkyl of 1 to 20 carbons; aryl of 6–24 carbons; aralkyl of 7 to 25 carbons; and carboxyl;

$R^1$ represents hydrogen; alkyl of 1 to 3 carbons; aryl of 6 to 10 carbons; or aralkyl of 7 to 11 carbons;

$R^2$ and $R^3$ independently represent alkyl of 1 to 6 carbons; aryl of 6 to 10 carbons; or aralkyl of 7 to 11 carbons; or taken together $R^2$ and $R^3$ represent a 5- or 6-membered ring containing atoms chosen from a group consisting of C, N, and O;

$R^4$ and $R^5$ independently represent hydrogen; or alkyl of 1 to 4 carbon atoms;

$R^6$ and $R^7$ independently represent alkyl of 1 to 6 carbons; aryl of 6 to 10 carbons; aralkyl of 7 to 11 carbons; or taken together $R^6$ and $R^7$ can represent a 5- or 6-membered ring containing atoms chosen from a group consisting of C, N, and O; and $Y^2$ and $Y^3$ represent O.

6. The photographic element of claim 1 wherein:

$R^1$ represents hydrogen; or alkyl of 1 to 3 carbons;

$L^1$ represents a chemical linkage or an alkyl of 1 to 3 carbons;

$R^2$ and $R^3$ independently represent alkyl of 1 to 3 carbons; or $R^2$ and $R^3$ are taken together to represent a 5- or 6-membered ring containing atoms chosen from a group consisting of C, N, and O; and $R^6$ and $R^7$ represent alkyl of 1 to 3 carbons; or $R^6$ and $R^7$ are taken together to represent a 5- or 6-membered ring containing atoms chosen from a group consisting of C, N, and O.

7. The photographic element of claim 6, wherein said at least one imidazolium compound is chosen from a group consisting of:

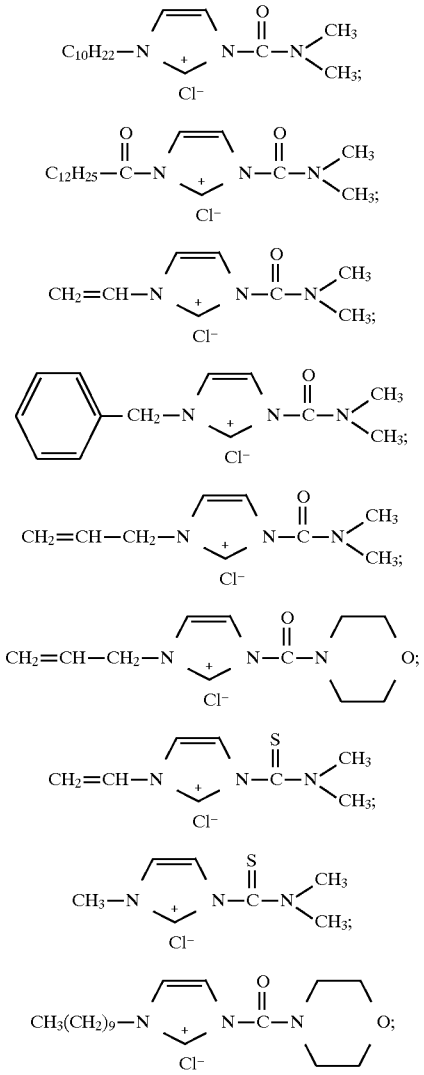

-continued

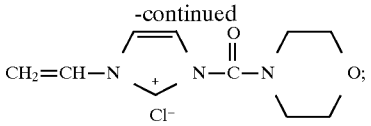

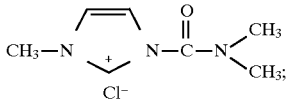

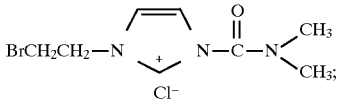

and

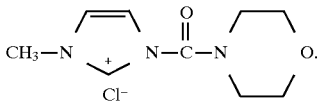

8. A process for forming a photographic element, comprising:

forming at least one liquid photographic emulsion in at least one storage vessel wherein said liquid photographic emulsion comprises silver halide, hydrophilic colloid and a hardening accelerator defined by:

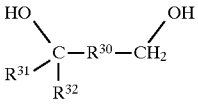

wherein:

$R^{30}$ is a chemical bond or alkyl of 1 to 12 carbons; aryl of 6 to 10 carbons, arylalkyl of 7 to 25 carbons; or —$(R^{33}—O—R^{34})_n$—;

$R^{31}$ and $R^{32}$ independently represent hydrogen or alkyl of 1 to 12 carbons; and $R^{33}$ and $R^{34}$ independently represent alkyl of 1 to 12 carbons;

transporting said liquid photographic emulsion to an injection region;

injecting into said liquid photographic emulsion in said injection region at least one imidazolium compound defined by

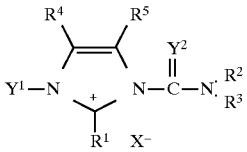

wherein:

$Y^1$ is an alkyl of 1 to 24 carbons; aryl of 6 to 24 carbons; aralkyl of 7 to 25 carbons; a 5- or 6-membered ring containing atoms chosen from a group consisting of C, N, O, and S; —$L^1CR^8CH_2$ or a polymer thereof; —$C(Y^4)E$; or

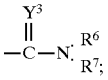

E is an alkyl of 1 to 24 carbons; aryl of 6 to 24 carbons; aralkyl of 7 to 25 carbons; —$OR^9$; —CN; or a 5- or 6-membered ring containing atoms chosen from a group consisting of C, N, O, and S;

$L^1$ is a linking group;

$R^1$ is hydrogen; alkyl of 1 to 24 carbons; aryl of 6 to 24 carbons; aralkyl of 7 to 25 carbons; —$OR^{10}$; halogen; nitro; carboxyl; mercapto; alkylamino of 1 to 24 carbons; or a 5- or 6-membered ring containing atoms chosen from a group consisting of C, N, O, and S;

$R^2$ and $R^3$ independently represent hydrogen; alkyl of 1 to 24 carbons; aryl of 6 to 24 carbons; or aralkyl of 7 to 25 carbons; or $R^2$ and $R^3$ independently represent, or are taken together to represent, a 5- or 6-membered ring containing atoms chosen from a group consisting of C, N, O, and S;

$R^4$ and $R^5$ independently represent hydrogen; alkyl of 1 to 24 carbons; aryl of 6 to 24 carbons; aralkyl of 7 to 25 carbons; nitro; carboxyl; mercapto; —$OR^{11}$; halogen; alkylamino of 1 to 24 carbons; or a 5- or 6-membered ring containing atoms chosen from a group consisting of C, N, O, and S; or $R^4$ and $R^5$ taken together represent a 5- or 6-membered ring containing atoms chosen from a group consisting of C, N, O, and S;

$X^-$ is a counterion;

$Y^2$, $Y^3$ and $Y^4$ independently represent O or S;

$R^6$ and $R^7$ independently represent hydrogen; alkyl of 1 to 24 carbons; aryl of 6 to 24 carbons; aralkyl of 7 to 25 carbons; or a 5- or 6-membered ring containing atoms chosen from a group consisting of C, N, O, and S; or $R^6$ and $R^7$ taken together represent a 5- or 6-membered ring containing atoms chosen from a group consisting of C, N, O, and S;

$R^8$ represents a hydrogen; an alkyl of 1 to 24 carbons; —$C(O)R^{12}$; —CN; or an aryl of 6 to 24 carbons;

$R^9$ represents hydrogen; alkyl of 1 to 24 carbons; or aryl of 6 to 24 carbons;

$R^{10}$ and $R^{11}$ independently represent hydrogen, or an alkyl of 1 to 5 carbons; and $R^{12}$ represents hydrogen; alkyl of 1 to 24 carbons; alkoxy of 1 to 24 carbons; amine; or alkylamine of 1 to 24 carbons;

transporting said liquid photographic emulsion to a coater;

coating said liquid photographic emulsion on a substrate; and removing said solvent from said liquid photographic emulsion to form a dry coated emulsion layer.

9. The process for forming a photographic element of claim 8 wherein:

$R^{30}$ is alkyl of 2 to 10 carbons; aryl of 6 carbons, arylalkyl of 7 to 18 carbons; or —$(R^{33}—O—R^{34})_n$—; and $R^{31}$ and $R^{32}$ independently represent hydrogen or alkyl of 1 to 10 carbons.

10. The process for forming a photographic element of claim 9 wherein:

$R^{30}$ is alkyl of 3 to 7 carbons substituted with alkoxy of 1 to 6 carbons; aryl of 6 carbons, arylalkyl of 7 to 10 carbons; or —$(R^{33}—O—R^{34})_n$—;

$R^{31}$ and $R^{32}$ independently represent hydrogen or alkyl of 1 to 7 carbons.

11. The process for forming a photographic element of claim 8 wherein:

$Y^1$ is an alkyl of 1 to 24 carbons; aryl of 6 to 24 carbons; aralkyl of 7 to 25 carbons; a 5- or 6-membered ring containing atoms chosen from a group consisting of C, N, O, and S; or

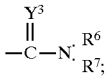

$L^1$ is chosen from a covalent chemical bond; alkyl of 1 to 20 carbons; aryl of 6–24 carbons; aralkyl of 7 to 25 carbons; and carboxyl;

$R^1$ represents hydrogen; alkyl of 1 to 3 carbons; aryl of 6 to 10 carbons; or aralkyl of 7 to 11 carbons.

$R^2$ and $R^3$ independently represent alkyl of 1 to 6 carbons; aryl of 6 to 10 carbons; or aralkyl of 7 to 11 carbons; or taken together $R^2$ and $R^3$ represent a 5- or 6-membered ring containing atoms chosen from a group consisting of C, N, and O;

$R^4$ and $R^5$ independently represent hydrogen; or alkyl of 1 to 4 carbon atoms;

$R^6$ and $R^7$ independently represent alkyl of 1 to 6 carbons; aryl of 6 to 10 carbons; aralkyl of 7 to 11 carbons; or taken together $R^6$ and $R^7$ can represent a 5- or 6-membered ring containing atoms chosen from a group consisting of C, N, and O; and $Y^2$ and $Y^3$ represent O.

12. The process for forming a photographic element of claim 8 wherein:

$R^1$ represents hydrogen; or alkyl of 1 to 3 carbons;

$L^1$ represents a chemical linkage; an alkyl of 1 to 3 carbons;

$R^2$ and $R^3$ independently represent alkyl of 1 to 3 carbons; or $R^2$ and $R^3$ are taken together to represent a 5- or 6-membered ring containing atoms chosen from a group consisting of C, N, and O; and $R^6$ and $R^7$ represent alkyl of 1 to 3 carbons; or $R^6$ and $R^7$ are taken together to represent a 5- or 6-membered ring containing atoms chosen from a group consisting of C, N, and O.

13. The process for forming a photographic element of claim 12, wherein said at least one imidazolium compound is chosen from a group consisting of:

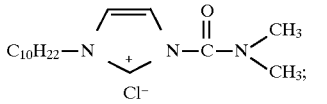

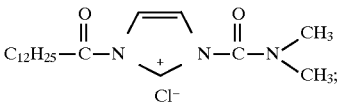

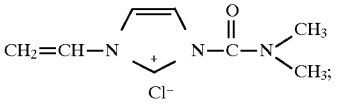

-continued

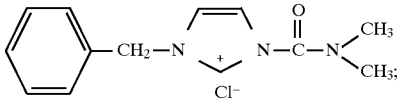

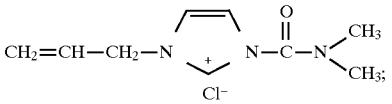

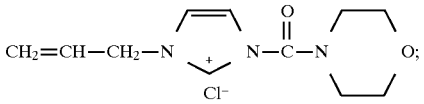

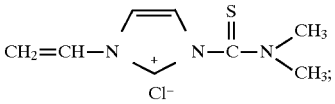

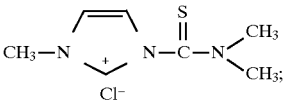

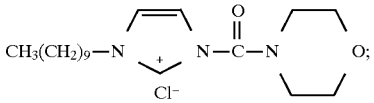

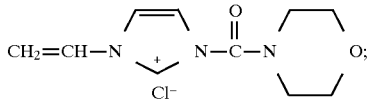

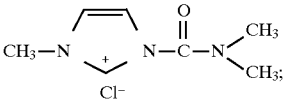

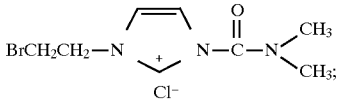

and

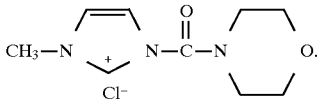

14. A photographic element comprising a photosensitive layer and at least one hydrophilic colloid layer hardened with at least one imidazolium compound of formula:

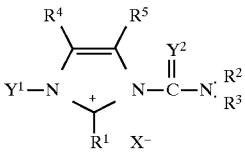

wherein:

$Y^1$ is

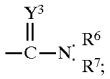

$R^1$ is hydrogen; alkyl of 1 to 24 carbons;

$R^2$ and $R^3$ independently represent hydrogen; alkyl of 1 to 24 carbons; aryl of 6 to 24 carbons; aralkyl of 7 to 25 carbons; or a 5- or 6-membered ring containing atoms chosen from a group consisting of C, N, O, and S; or $R^2$ and $R^3$ taken together represent a 5- or 6-membered ring containing atoms chosen from a group consisting of C, N, O, and S;

$R^4$ and $R^5$ independently represent hydrogen; alkyl of 1 to 24 carbons; halogen; or $R^4$ and $R^5$ taken together represent a 5- or 6-membered ring containing atoms chosen from a group consisting of C, N, O, and S;

$X^-$ is a counterion;

$Y^2$, $Y^3$ represent O;

$R^6$ and $R^7$ independently represent hydrogen; alkyl of 1 to 24 carbons; aryl of 6 to 24 carbons; aralkyl of 7 to 25 carbons; or a 5- or 6-membered ring containing atoms chosen from a group consisting of C, N, O, and S; or $R^6$ and $R^7$ taken together represent a 5- or 6-membered ring containing atoms chosen from a group consisting of C, N, O, and S; and said at least one hydrophilic colloid layer further comprises a hardening accelerator defined by:

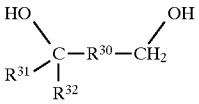

wherein:

$R^{30}$ is a chemical bond or alkyl of 1 to 12 carbons; aryl of 6 to 10 carbons, arylalkyl of 7 to 25 carbons; or $—(R^{33}—O—R^{34})_n—$;

$R^{31}$ and $R^{32}$ independently represent hydrogen or alkyl of 1 to 12 carbons; and $R^{33}$ and $R^{34}$ independently represent alkyl of 1 to 12 carbons.

15. The photographic element of claim 14 wherein:

$R^{30}$ is alkyl of 2 to 10 carbons; aryl of 6 carbons, arylalkyl of 7 to 18 carbons; or $—(R^{33}—O—R^{34})_n—$; and $R^{31}$ and $R^{32}$ independently represent hydrogen or alkyl of 1 to 10 carbons.

16. The photographic element of claim 15 wherein:

$R^{30}$ is alkyl of 3 to 7 carbons substituted with alkoxy of 1 to 6 carbons; aryl of 6 carbons, arylalkyl of 7 to 10 carbons; or $—(R^{33}—O—R^{34})_n—$;

$R^{31}$ and $R^{32}$ independently represent hydrogen or alkyl of 1 to 7 carbons.

17. The photographic element of claim 16 wherein said hardening accelerator is chosen from a group consisting of:

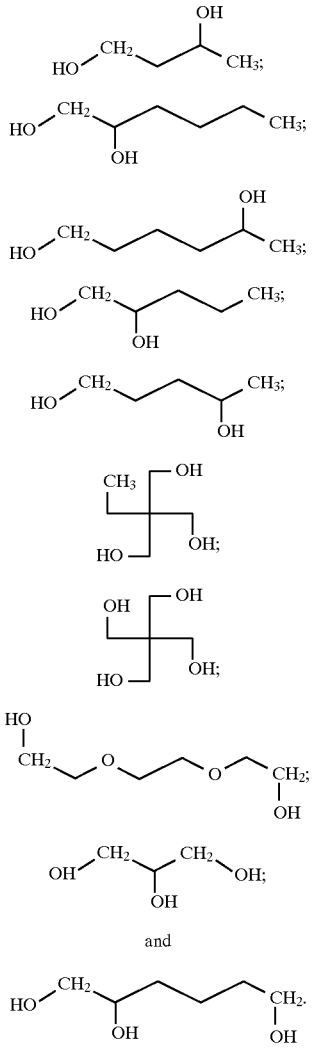

and

* * * * *